United States Patent [19]

Herne, Jr.

[11] 4,291,669

[45] Sep. 29, 1981

[54] EFFICIENT FUEL BURNING STOVE OR FURNACE WITH THERMAL ENERGY SLOW PROPAGATION FLUE STRUCTURE

[76] Inventor: Robert H. Herne, Jr., 121 Woodbridge Rd., York, Me. 03909

[21] Appl. No.: 51,683

[22] Filed: Jun. 25, 1979

[51] Int. Cl.[3] ..... F24C 15/28

[52] U.S. Cl. ..... 126/83; 126/99 P; 126/112; 126/123; 110/214; 110/326

[58] Field of Search ..... 110/322, 342, 323, 344, 110/326, 345, 203, 208, 210, 211, 214; 126/120, 121, 123, 58, 83, 99 D, 112; 432/181, 223

[56] References Cited

U.S. PATENT DOCUMENTS

| | | | |
|---|---|---|---|
| 32,427 | 5/1861 | Kohler | 126/99 P |
| 665,658 | 1/1901 | Jankus | 110/326 |
| 1,464,210 | 8/1923 | Marx | 110/322 |
| 2,364,698 | 12/1944 | Davin | 126/83 |
| 2,369,995 | 2/1945 | Arnold | 110/326 |
| 3,043,246 | 7/1962 | Hebert | 110/211 |
| 4,015,932 | 4/1977 | Zurawski | 432/223 |
| 4,123,979 | 11/1978 | Tesch | 110/214 |

*Primary Examiner*—Henry C. Yuen
*Attorney, Agent, or Firm*—Daniel H. Kane, Jr.

[57] ABSTRACT

A stove or furnace for combusting and extracting heat from wood and wood-type fuels includes a firebox arrangement for primary combustion and a flue structure coupled to the firebox which includes a plurality of flue gas decelerating chambers for slowing propagation of flue gas, heat exchange to the environment, and further combustion of fuel constituents in the flue gas. The chambers are coupled in series through restricting and accelerating passageways for maintaining draft between chambers, finally leading to an outlet chimney. The chambers are formed with baffles for greater turbulant mixing, combustion, and heat exchange. Furthermore, a tubular conduit may be provided extending from the firebox through the flue structure chambers. The tubular conduit is formed with orifices for injecting burning flue gas from the firebox primary combustion directly into the series coupled chambers to enhance secondary burning. A new method for combustion of wood and carbonaceous fuels and extracting heat is also described.

16 Claims, 19 Drawing Figures

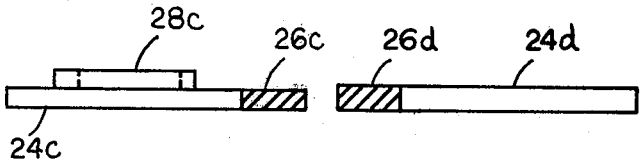
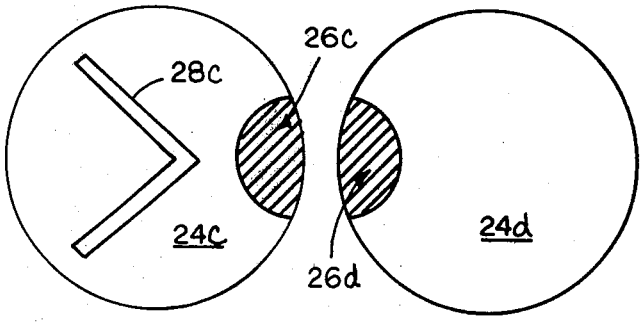
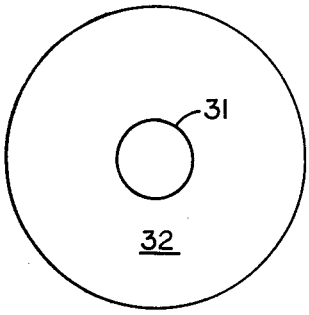
FIG 6D FIG 6E FIG 6F
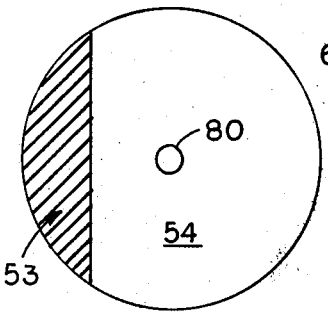
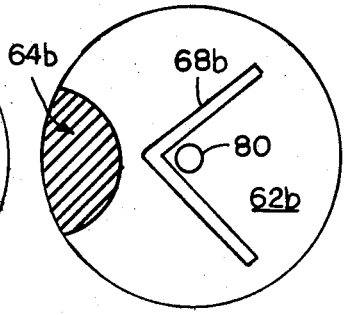
FIG 8A FIG 8B

EFFICIENT FUEL BURNING STOVE OR FURNACE WITH THERMAL ENERGY SLOW PROPAGATION FLUE STRUCTURE

FIELD OF THE INVENTION

This invention relates to new and improved stoves and furnaces for burning and extracting usable heat with high efficiency from wood or other carbonaceous fuels.

BACKGROUND OF THE INVENTION

Renewed interest in wood, coal, peat and other carbonaceous fuels for heating requirements in homes and commercial buildings has been accompanied by a revival of the traditional wood stove and the production and marketing of new varieties of stoves and furnaces for combusting wood and similar fuels. A disadvantage of such currently available stoves is that at best they are inefficient with as much as 70% of the recoverable thermal energy from such fuels lost up the flue or chimney in the form of direct heat and smoke containing constituents of fuel and flue gas volatiles that have been only partially combusted. Thus, as a result of incomplete burning of fuel and failure to efficiently extract and exchange heat generated by portion of the fuel actually combusted, such stoves unlock and make available for heating as little as 30% of the potentially available energy of the carbonaceous fuels. Furthermore, so called "creosote" deposits in flues and chimneys from unburned fuel fractions present health and safety problems and must be removed regularly.

SUMMARY OF THE INVENTION

It is therefore an object of the present invention to provide new and improved stoves and furnaces which effect essentially complete combustion of wood and similar fuels such as peat, coal and other carbonaceous fuels, and the fuel constituents and flue gas volatiles and fractions characteristically derived from such fuels during burning, accessing nearly all the chemical energy of the fuel for conversion to available heat energy.

Another object of the invention is to efficiently extract and exchange from the flue gas derived by such complete burning, all of the heat practicable for delivery by radiation, convection and conduction to the surrounding environment for heating requirements.

In order to accomplish these results, the present invention contemplates providing a new and improved stove or furnace for combusting and extracting heat from wood and carbonaceous fuels including a firebox arrangement for primary combustion of said fuels and a flue structure coupled to said firebox comprising a plurality of flue gas decelerating chambers for slowing propagation of flue gas, heat exchange to the environment, and further combustion of fuel constituents in the flue gas. The chambers are coupled in series through restricting said accelerating passageways for maintaining draft between chambers, finally leading to an outlet for venting the output of the series alternating accelerating and decelerating flue gas structure.

According to other aspects of the invention, the chambers are formed with baffles for deflecting and spreading flue gas accelerated into the chambers, for greater turbulence, mixing, combustion, and heat exchange. Furthermore, there may be provided a tubular conduit extending from the firebox through the flue structure chambers, formed with orifices for injecting burning flue gas from the firebox primary combustion into said series coupled chambers to enhance secondary burning in said flue structure chambers, and increase heat exchange and draft.

Thus, the invention also contemplates a new and improved method for combustion and extracting heat from wood and carbonaceous fuels comprising igniting and burning said fuel in a primary combustion, and alternately accelerating and drafting on the one hand, and decelerating and spreading on the other hand, the flue gas from said primary burning step, maintaining draft during the accelerating steps, and slowing propagation, exchanging heat to the environment, and further combusting or pyrolizing the constituents of the flue gas during the deceleration steps.

A feature and advantage of the foregoing flue structure and method is that the series coupled decelerating and spreading chambers form a "tortuous" passageway amounting to a thermal energy "slow wave structure", slowing propagation of flue gas from the primary combustion through the series coupled, baffled chambers. By this expedient, flue gas can be subjected to selected multiple secondary burning and handling during the slowed propagation and essentially all the heat practicable can be extracted from the flue gas during its prolonged travel through the series alternating accelerating and decelerating flue structure. In one respect, it might be said that the chimney, where energy is normally lost, has effectively been compressed into the stove or furnace for complete fuel burning and heat extraction.

In the preferred embodiment of the invention, the thermal energy "slow propagation" flue structure for receiving and conducting flue gas from the primary burn firebox comprises a plurality of as many as six chambers stacked one above the other with common walls separating the chambers, each chamber communicating with adjacent chambers through successive openings through the common walls adapted to accelerate flue gas and enhance draft between chambers. The chambers are formed with baffles for deflecting and spreading flue gas accelerated into the chambers, and the openings or accelerating passageways are formed in the common chamber walls in successive alternate non-aligned positions in the common chamber walls of said series coupled chambers. A feature and advantage of this arrangement is that flue gas accelerated into each chamber through the non-aligned coupling passageways produces hot spots on the common wall of the next adjacent chamber to enhance secondary combustion and pyrolosis of flue gas decelerating and turbulently spreading in the next chamber and contacting the heated portions on the common wall.

Furthermore, in the preferred embodiment, the fuel burner and heat extractor is contained in a cylindrical housing for greater efficiency in distribution and multiple combustion of flue gas constituents and greater efficiency in heat exchange through radiation, convection and conduction to the surrounding environment. The common walls separating chambers comprise circular plates which may be formed of refractory material, supported in the cylindrical housing, whereas the remainder of the stove structure may be sheet metal, steel plate, or cast iron etc. The first chamber over the firebox, defined by the first and second circular plates over the firebox is reserved as a secondary burning chamber with means for introducing secondary air from outside the stove into the secondary burning chamber to support secondary combustion. Following the secondary burning chamber are the series coupled slow propagation chambers according to the arrangement described above whereby flue gas from the primary and secondary combustion is alternately accelerated for maintaining draft and decelerated and spread for slowing propagation, exchanging heat to the environment, and further combustion or pyrolysis as the spreading flue gas contacts hot spots in the common walls of the chambers produced by accelerating flue gas passing through the non-aligned ports striking the common wall plate with the previous chamber.

According to another aspect, the invention contemplates a new and improved secondary air induction and preheating structure for wood stoves of the type having a primary burn firebox and a secondary burning chamber coupled through a passageway with the firebox. This structure includes a first elongate tube with fins to facilitate heat exchange, said heat exchange tube positioned in the primary burn firebox below the passageway having an inlet for drawing secondary air from outside the stove and an outlet extending into the secondary burning chamber. The structure also includes a second elongate tube positioned within the secondary burning chamber and coupled to the heat exchange tube outlet and formed with a slit for injecting a distributed sheet of preheated secondary air into the secondary burning chamber to support secondary combustion of flue gas. Yet additional aspects of the invention relate to damper and drafting arrangements.

Other objects, features and advantages of the present invention will become apparent in the following specification and accompanying drawings.

BRIEF DESCRIPTION OF THE DRAWINGS

FIGS. 6A–6E are detailed plan views and correlated side views of the flue structure common wall plates 16,24*a*,24*b*,24*c*, and 24*d* and baffles 28*a*, 28*b*, and 28*c* respectively as designated in FIGS. 6 and 7 while FIG. 6F is a detailed plan view of the top plate or cover 32.

FIG. 8A is a detailed plan view of the common wall plate separating the primary burn firebox and secondary combustion chamber. The hatched area represents the opening.

FIG. 8B is a detailed plan view of a typical common wall plate and baffle separating the series couple slow propagation flue structure chambers. The flue opening is hatched.

DESCRIPTION OF THE PREFERRED EMBODIMENT

Figure 1:
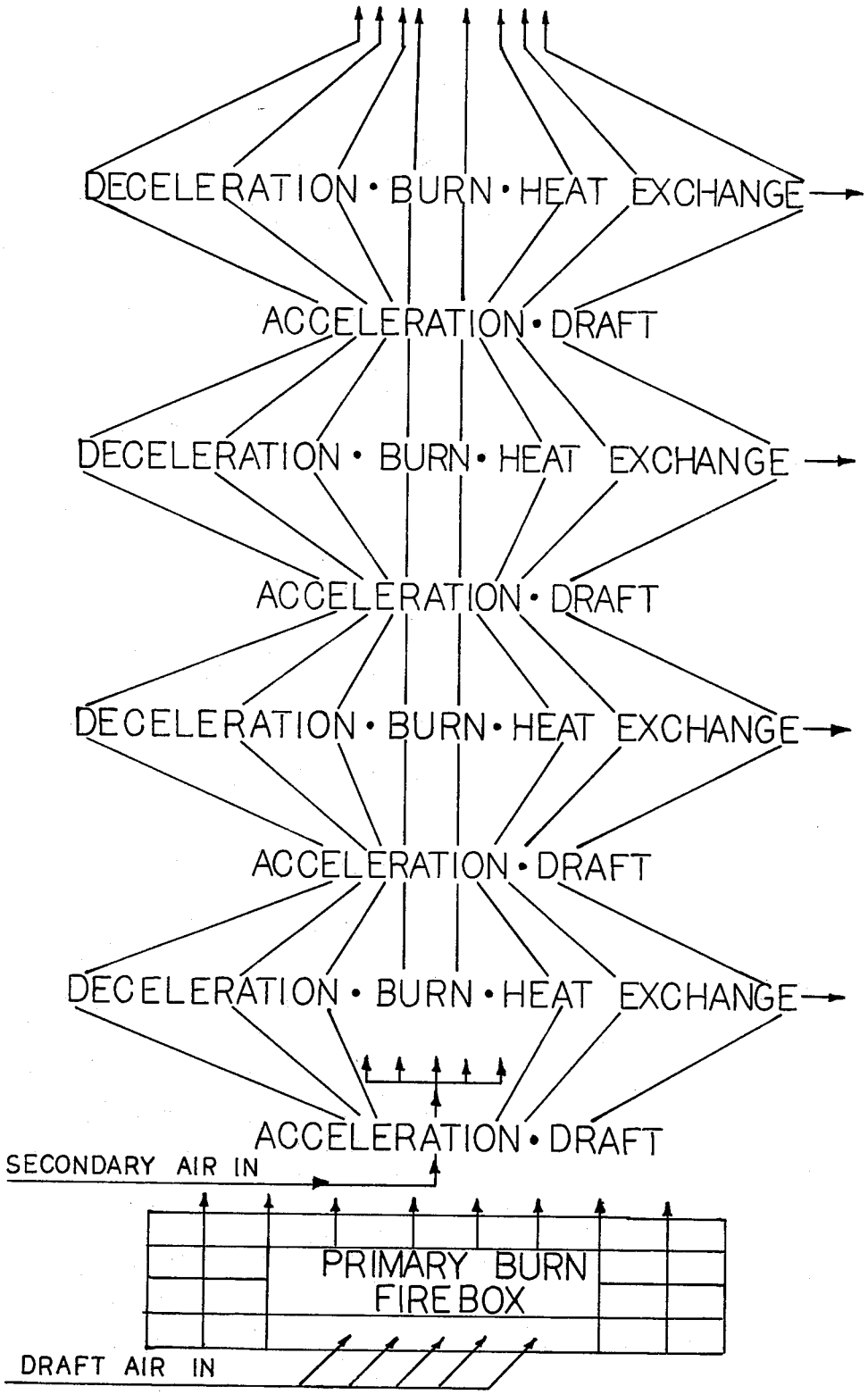
FIG. 1 is a diagrammatic flow chart of flue gas and thermal energy paths which develop according to the method and in the apparatus of the present invention.

A flow chart diagrammatically presenting the flue gas and thermal energy paths which develop according to the method and in the apparatus of the present invention is illustrated in FIG. 1. The structures contemplated by the present invention amount to novel thermal energy "slow wave structures" or slow propagation structures for novel methods of combusting and extracting heat from carbonaceous fuels. According to the invention and as illustrated, primary combustion takes place at the base of the structure with appropriate draft air supporting the primary burn. From the primary burning step the flue combustion gases are accelerated through a passageway into a secondary burning chamber where the partially burned fractions and smoke in the flue gas are decelerated, spread and subjected to secondary burning. Secondary air inducted into this region supports and enhances secondary burning. Furthermore, heat exchange at the extremities of the spreading secondary burn region with the environment begins.

As further illustrated in the chart, the flue gas undergoes a succession of steps involving acceleration through ports or passageways and deceleration, spreading, further burning in the next adjacent chamber and heat exchange at extremities with the environment. After multiple alternating accelerating and decelerating steps in which draft is enhanced between chambers by venturi-like acceleration, and multiple secondary burning and heat exchange with the environment is enhanced by deceleration, spreading and other processing, the flue gas from which maximum energy has been extracted is vented to the external chimney or flue. Further illustration of the flue gas and thermal energy processing will become apparent with reference to the following more detailed drawings.

Figure 2:
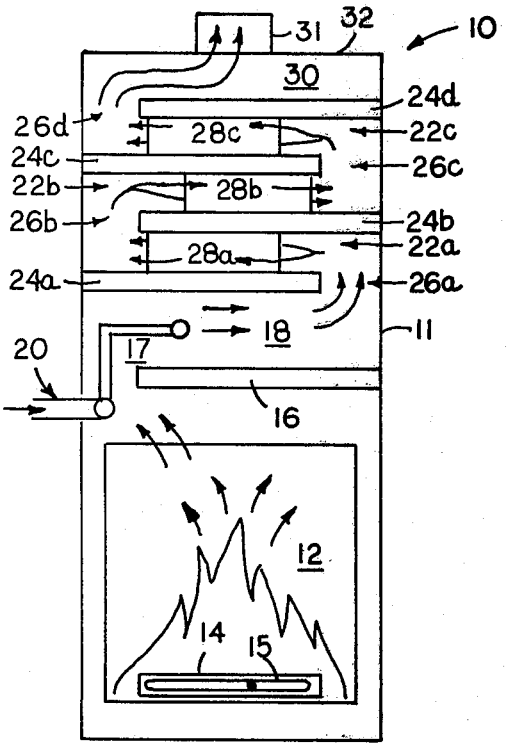
FIG. 2 is a diagrammatic side view of a wood stove or furnace according to the present invention with cylindrical housing wall cutaway showing the path of flue gas through the series coupled decelerating and spreading chamber flue structure.
Figure 10:
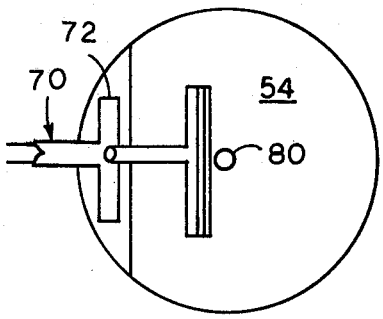
FIG. 10 is a cutaway plan view looking down on the firebox from the secondary burning chamber showing the novel secondary air induction device and secondary burn orifice.
Figure 11:
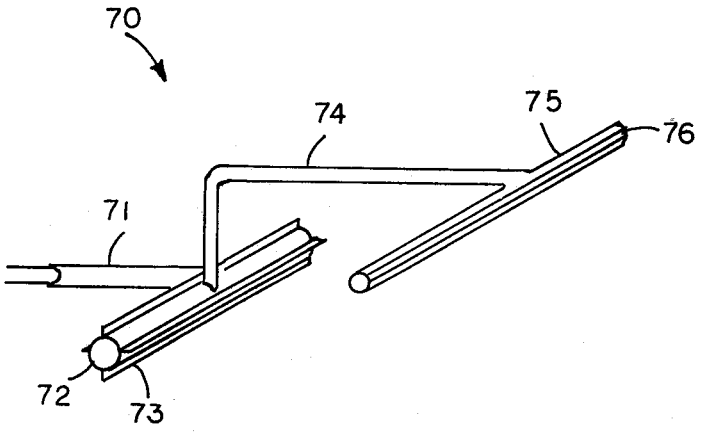
FIG. 11 is a perspective view of the secondary air induction device and secondary burn orifice.

Actual flue gas flow in a woodstove 10 constructed according to the present invention is diagrammatically illustrated in FIG. 2 with stove structure illustrated in greater detail with corresponding reference numbers in FIGS. 3–7. The woodstove is formed with a cylindrical housing 11 at the base of which is fitted a firebox 12 suitable for primary combustion of wood or other carbonaceous fuels. The firebox may be lined with refractory material. The stove housing may be formed of sheet metal, steel plate, cast iron etc. The firebox includes a starting damper 14 with sliding panel 15 to control and either restrict or enhance draft air to support primary combustion within the firebox. An automatic damper 13 may also be provided at the rear of the firebox (see FIG. 5) to regulate and admit draft air as required once the starting damper 14 is manually shut. The roof or top of firebox 12 is defined by a circular plate or common wall 16 which rests on protuberances 37 welded to the stove wall or housing. Plate 16 forms the common wall or separator between the firebox 12 and secondary burning chamber 18 and is formed with a cutout, port or passageway 17 on one side which permits passage of flue gas from the primary burn firebox 12 to the secondary burning chamber 18 at the side of the stove. Secondary air for supporting and enhancing secondary burning of flue gas fuel constituents is drawn in, preheated, pressurized and delivered by the secondary air induction device 20 described hereafter in detail with reference to FIGS. 10 and 11.

The flue structure over the primary firebox 12 and secondary burning chamber 18 is thereafter defined by a succession or stack of decelerating and spreading chambers 22*a*, 22*b*, and 22*c* defined by common walls or plates 24*a*, 24*b*, 24*c*, and 24*d* generally circular in shape and supported within the stove 10 by ribs welded to the wall 11 of the stove. The common wall dividers 24*a*, 24*b*, 24*c* and 24*d* are formed with cutouts or ports 26*a*, 26*b*, 26*c*, and 26*d* at alternate sides which provide passageways for the flue gas between chambers and which in series with the chambers define a tortuous passageway "slow propagation structure" for the flue gas and thermal energy produced by the primary and multiple secondary burning of fuel hereafter described. Within the stacked series coupled chambers are positioned "V" shaped baffles 28*a*, 28*b*, and 28*c* with the point of the baffles directed upstream into the flow of flue gas dividing and spreading the flue gas and introducing turbulence as the flue gas spreads around the baffles to the extremities of the stove walls 11. Finally, the residue escapes through cavity 30 at the top of the stove to the chimney outlet 31.

In the operation of the stove, the gaseous products of primary combustion in firebox 12 are accelerated through passageway 17 with a venturi-like effect into the secondary burning chamber where preheated secondary air is injected by secondary air induction device 20 to support and enhance secondary burning. The flue gas residues and thermal energy contained in it thereafter progress through the tortuous flue structure, accelerated at the passageways or cutouts 26*a*, 26*b*, 26*c*, and 26*d* for improved draft, and decelerating, spreading, further combusting and heat exchange with the environment in the chambers 22*a*, 22*b*, and 22*c*. The spreading and turbulence introduced by baffles 28*a*, 28*b* and 28*c* facilitates mixing of the fuel fractions and flue gas constituents for further burning and heat exchange with the environment at the walls 11 of the stove 10.

By reason of the opposite and alternate positions through successive common walls or plates 24*a*, 24*b*, 24*c* and 24*d* of the cutouts or ports 26*a*, 26*b*, 26*c*, and 26*d*, hot flue gas rushing or accelerating through these passageways impinges upon the bottom of the next adjacent common wall or plate heating it and producing "hot spots" which are contacted by decelerated and spreading gas in the next adjacent chamber enhancing secondary and multiple secondary combustion of the fuel gas components. Thus, gas spreading around the V baffle in each chamber becomes turbulent, mixes and hits the "hot spot" behind the baffle caused by the hot flue gas rushing into the previous chamber through a "venturi" port and striking the upper common wall. The "hot spots" thus form at alternate sides as the tortuous flue structure turns back on itself increasing direct heat transfer between chambers and further combustion of fuel gas constituents. Furthermore, the heating of the next chamber by the rush of incoming flue gas and heat transfer between chambers during deceleration cause the next chamber to draw flue gas increasing the draft. The chambers are thus "draft producing".

The V baffles beneficially divert the hot flue gases to the extremities or walls of the wood stove for greater efficiency in heat exchange with the surrounding environment. The side to side deflection around each turn exchanges heat and then recontacts the gas with the heated surface around the baffle. The overall effect as the flue gas progreses through the alternating slow propagation thermal energy and flue gas structure is near complete burning and near complete extraction of available heat to the extent practicable.

Figure 12:
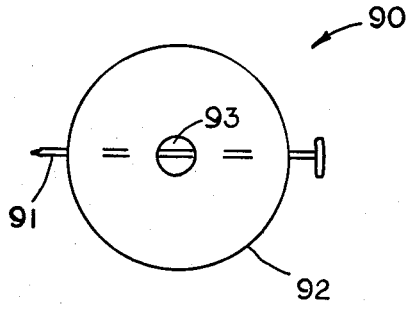
FIG. 12 is a plan view of a damper device for mounting in the flue structure outlet.

The final cavity of chamber 30 serves as a collection chamber and deposit surface for remaining creosote and incompletely combusted constituents of the smoke where deposits can be easily removed and cleaned. With a cylindrical wood stove of the foregoing construction having a two foot diameter and height of approximately 4 to 5 feet, combustion of a cord and a half of green wood produced only one and a half quarts of ash and creosote in the top chamber with no deposits in the preceding chambers. This is accomplished with only a one inch diameter draft air hole inlet in automatic draft 13 and a one inch diameter hole in the damper device (see FIG. 12) placed in the stove outlet 31. To facilitate vacuum cleaning, a removable top 32 is provided. In addition, inspection ports of refractory glass or vacuum ports may be provided down the side wall of the stove to facilitate inspection and cleaning of lower chambers. Cleaning can also be accomplished however, by lifting out and removing successive common wall plates 24*d*, then 24*c*, then 24*b* etc. for access and cleaning.

Figure 3:
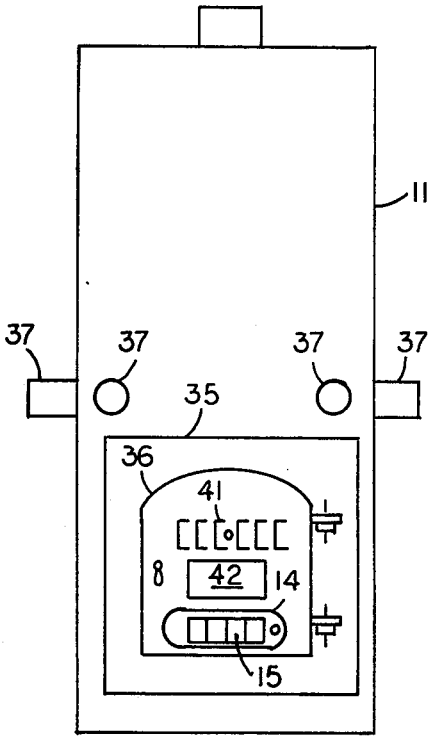
FIG. 3 is a front view of the assembled wood stove or furnace.
Figure 4:
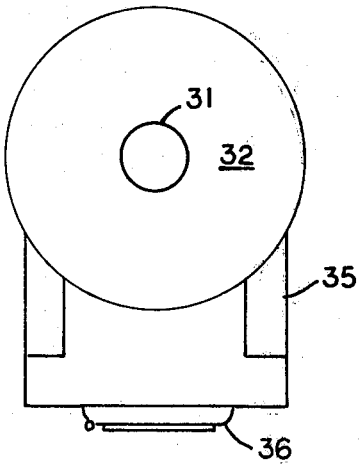
FIG. 4 is a plan view from above looking down on the top of the assembled wood stove.
Figure 5:
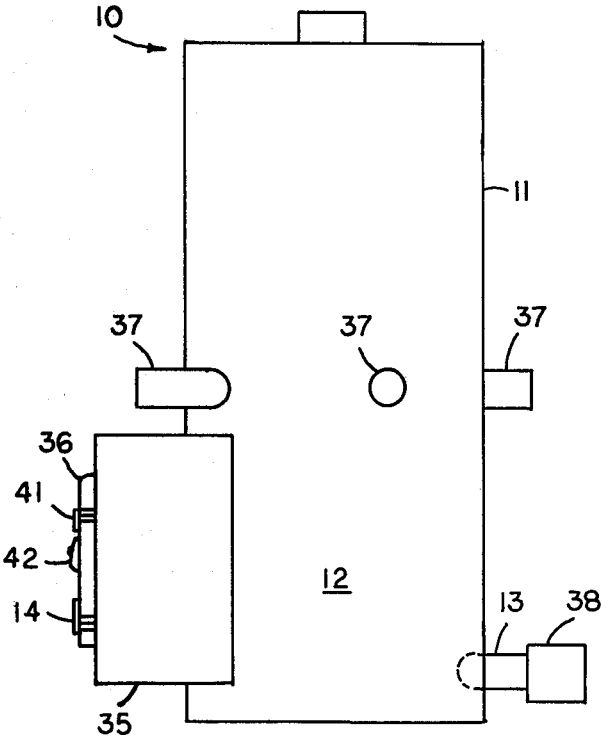
FIG. 5 is a side view of the assembled wood stove.
Figure 6:
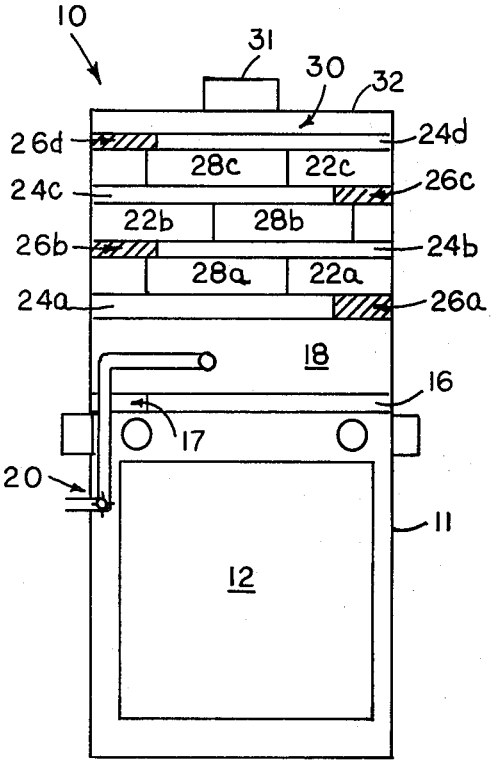
FIG. 6 is another front view of the wood stove or furnace, however with the upper wall of the cylindrical housing cutaway to show the structure and arrangement of the chamber common wall plates and baffles. Hatched areas represent cutout ports or passageways in the alternate opposite sides of the plates.
Figure 7:
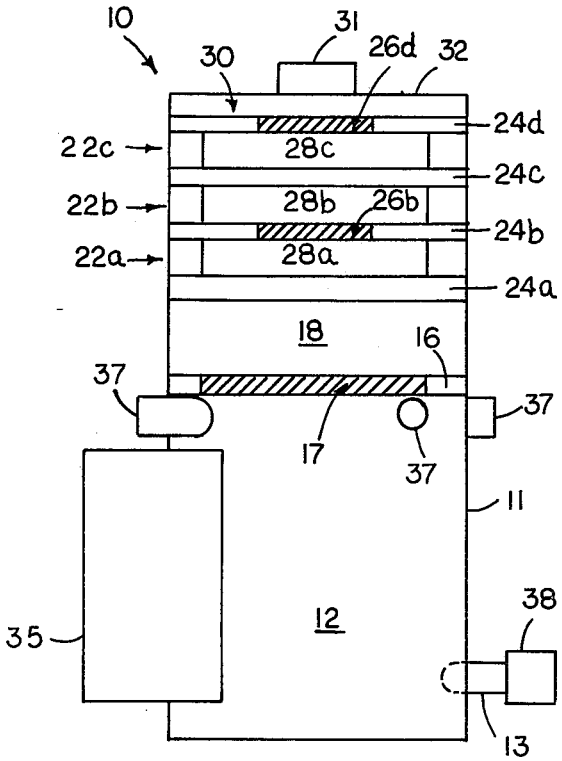
FIG. 7 is another side view of the wood stove or furnace, however with the upper wall of the cylindrical housing cutaway to to show the structure and arrangement of the chamber common wall plates and baffles from the side, correlated with FIG. 6 and shown in detail in FIGS. 6A–6E. In order to simplify the drawing and for clarity, the secondary air induction device is not shown.
Figure 6A:
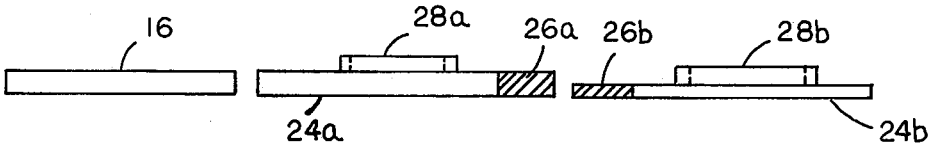
Figure 6A:
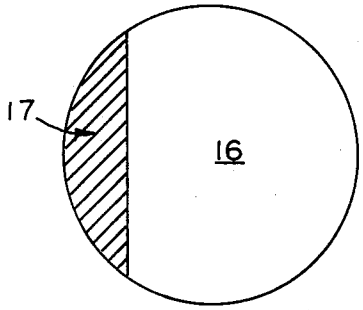
Figure 6B:
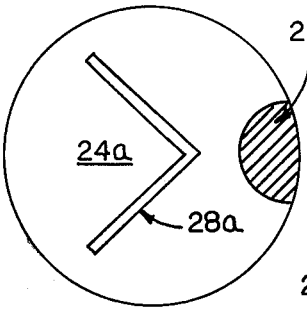
Figure 6C:
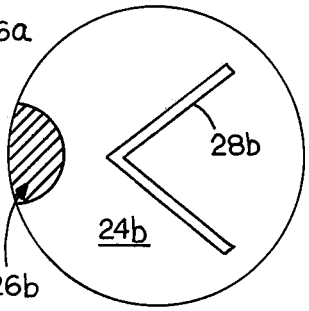

Referring to some of the external features of the stove particularly apparent in FIGS. 3–4, the firebox includes a rectangular firebox extension 35 on which is hingedly mounted air tight door 36. Air tight sliding damper 14 and slide 15 are mounted in the door 36 which may also be fitted with an upper starting damper 41 and air door 42. The airtight starting dampers 15 and 41 would normally be used in start up of fuel combustion in the primary firebox and then closed. Primary air is thereafter derived from automatic damper 13 which includes motor 38. Manually operated dampers 14 and 36 may also be used, however, during steady state burning.

The stove housing and components can be made of sheet metal, cast iron, steel plate etc. The primary firebox can be lined with refractory material as heat exchange through the firebox is not essential because of the efficient heat extraction in the overlying flue structure of the present invention. The common wall plates 24 are preferably of masonry or refractory material but metal might also be used. The cylindrical shape of the stove housing, the preferred form, optimizes many of the processes taking place in the stove including spreading and mixing, and heat exchange with the surrounding environment. As many as six series coupled decelerating, mixing and spreading chambers can be used to advantage in achieving complete combustion and heat extraction from the fuel to the extend practicable.

Figure 8:
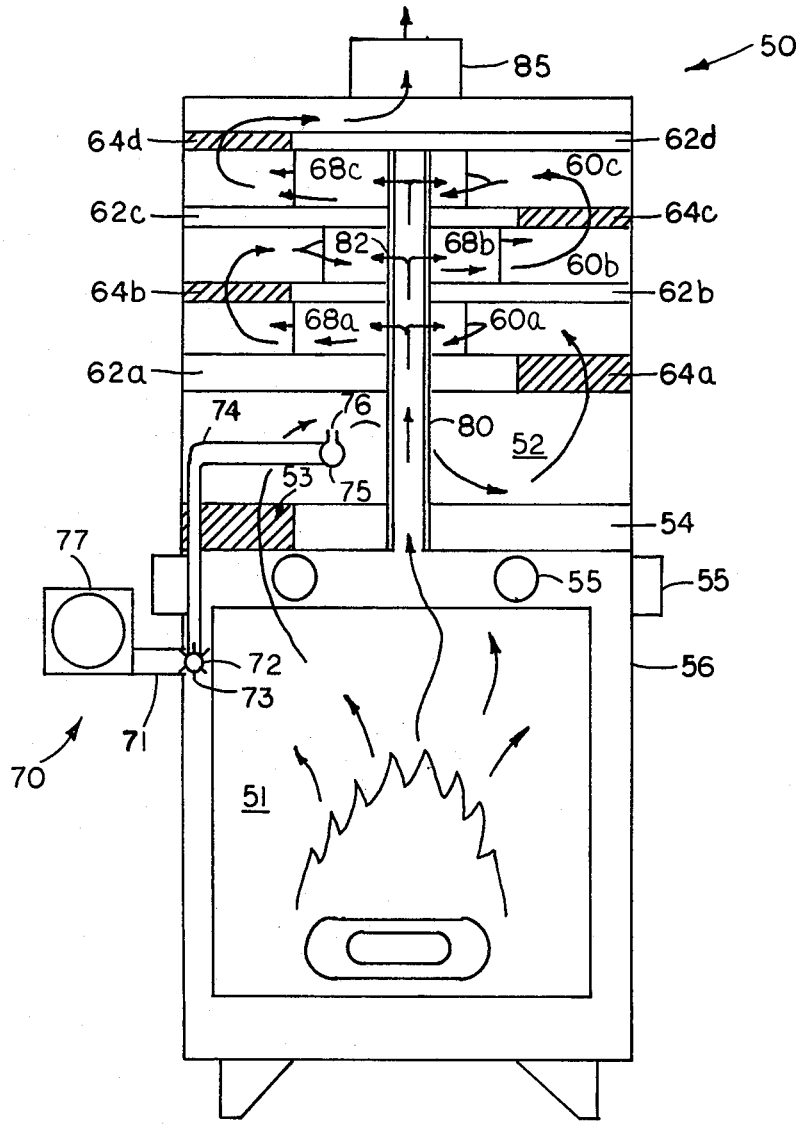
FIG. 8 is a diagrammatic side view with the cylindrical housing side wall cutaway showing the structure of another wood stove or furnace according to the present invention incorporating the central conduit passageway from the primary burning firebox for injecting burning gas into the series coupled slow propagation chambers, and showing the novel secondary air induction device, and flow of flue gas through the series coupled chambers.
Figure 9:
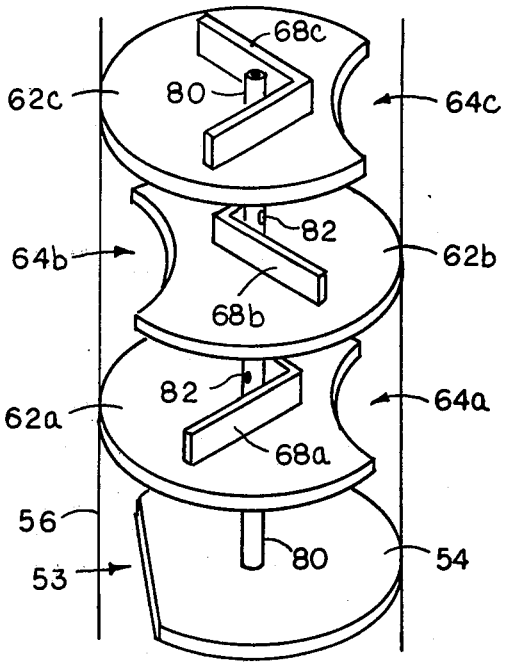
FIG. 9 is a partial and exploded perspective view with side wall cutaway of the cylindrical slow propagation flue structure further illustrating and disclosing the structure and arrangement of the chambers and the common wall plates and baffles. The central conduit passageway for injecting hot burning flue gas from the primary burn firebox into the chambers is also shown.

Another wood stove similar to that described above but including an axial tubular conduit extending from the firebox through the flue structure chambers and formed with orifices for injecting burning flue gas from the primary burn firebox directly into the series coupled chamber to enhance draft and secondary burning is illustrated in FIGS. 8 and 9.

The woodstove 50 is similarly constructed in a cylindrical configuration with firebox 51 at the base and flue structure containing secondary combustion chamber 52 coupled in series to the firebox through passageway 53 and common wall plate 54 which rests on protuberances 55 formed in the cylindrical wall 56 of wood stove 50. Following the secondary combustion chamber 52, the flue structure includes the series coupled slow propagation chambers 60*a*, 60*b*, and 60*c* defined by common wall plates 62*a*, 62*b*, 62*c*, and 62*d* formed with alternating oppositely aligned ports or passageways 64*a*, 64*b*, 64*c*, and 64*d* respectively. "V" baffles 68*a*, 68*b*, and 68*c* are positioned in chambers 60*a*, 60*b*, and 60*c* respectively, with the "V" pointing upstream into the flue gas flow. By way of example, details of two of the common wall plates 54 and 62*b* are shown in FIGS. 8A and 8B.

The protruding elements 55 which support the common wall plate 54 between the firebox and secondary combustion chamber instead of mere protuberances may be in the form of pipes extending through the upper part of the firebox for convection and heating of environmental air freely passing through pipes and exchanging heat with the hot flue gas of primary combustion. Such pipes might be for example, 2 inches in diameter. Similarly, in the wood stove illustrated in FIGS. 3–7, the protruding elements 37 may also be in the form of environmental air heating and convection pipes extending through the upper aspect of the firebox 12.

Flue gas from the primary combustion in firebox 51 is drawn through passageway 53 into the secondary burn chamber 52 where the flue gas constituents and partially burned hydrocarbons are subjected to a sheet of secondary air to support and enhance more complete burning. The secondary air is delivered by a special secondary air induction device 70 shown in further detail and here described with additional reference to FIGS. 10 and 11. The secondary air induction device 70 includes an inlet 71 for drawing air from outside the stove leading through a "T" joint into the middle of an elongate or tubular heat exchanger 72 formed with fins or veins 73 for increasing preheating of the secondary air by hot gas in the firebox 51. An outlet passageway 74 leads from heat exchanger 72 into the secondary combustion chamber 52 where the outlet 74 connects through another "T" joint into the middle of a second elongate tube 75 formed with a longitudinal slit 76 which may be, for example, a 1/16 inch slit extending the length of tube 75. The tube 75 and slit 76 provide a secondary air delivery nozzle for delivering a sheet of secondary air into the mass of flue gas spreading in the secondary combustion chamber 52. The overall effect of the secondary air induction device is to preheat air and increase pressure of air at the outlet delivery nozzle slit 76. The preheated and pressurized air is also distributed upon delivery through the mass of partially burned flue gas constituents in the secondary combustion chamber 52. In order to further pressurize the secondary air and increase rate of delivery, a blower 77 may be added to the secondary air induction inlet 71.

The woodstove illustrated in FIGS. 8 and 9 is also provided with a central conduit 80 leading from the firebox 51 axially upward through the center of the cylindrical flue structure and formed with openings or orifices 82 for directing jets of hot burning gas from the primary combustion directly into the slow propagation chambers 60*a*, 60*b*, and 60*c* to enhance the draft of gas through the passageways and to enhance multiple secondary burning of flue gas decelerated, spread and turbulently mixing within the slow propagation chambers. The central conduit or pipe 80 may be, for example 1 inch in diameter with ½ inch diameter holes or orifices 82. In other respects, the operation of the stove and the flow of flue gas and thermal energy is similar to that already described with respect to FIGS. 1–7. The added injection of primary burning flue gas into the chambers, however, increases the efficiency and completeness of combustion and the extraction of practicable heat from the fuel.

After alternately accelerating and drafting on the one hand, and decelerating, spreading, turbulently mixing, further combusting, an exchanging heat to the surrounding environment on the other hand as it wends its way through the tortuous flue gas passageway of series coupled slow propagation chambers, the now low energy flue gas is vented and finally drafted through the stove outlet 85 to the final chimney or other flue arrangement. In this final circular outlet, typically 6 inches in diameter, a novel damper according to the present invention may be installed. Such a damper 90, illustrated in FIG. 12 includes the rotatable mounting pin 91 fitted through holes drilled in the stove pipe flue above the outlet or directly in the outlet 85, and a circular damper plate 92 supported on the pin 91 within the stove pipe or in the outlet 85 to block the draft when in the horizontal position or in a plane perpendicular to the flue pathway. However, unlike conventional stove pipe dampers, the damper 90 of the present invention is formed with a one inch diameter hole 93 in the center to permit a restricted minimum flow of spent flue gas even when the damper is closed. During operation of the stove after primary combustion has reached a steady state, the airtight starting dampers on the front of the stove are closed and the one inch diameter automatic damper at the rear of the stove is opened to admit a one inch stream of draft air. Similarly, at the outlet 85 the damper is closed permitting outflow of a one inch diameter stream of spent flue gas. Using a stove with cylindrical diameter of 2 feet, such drafting and damping arrangements provide efficient burning and heat extraction.

While particular examples have been described, the number of slow propagation chambers coupled in series may vary according to the invention and as many as up to six such series coupled chambers may be used to advantage in order to extract all the practicable thermal energy available from the fuel and fuel residues of primary combustion.

I claim:

1. A new and improved stove or furnace for combusting and extracting heat from wood and carbonaceous fuels comprising:

firebox means for primary combustion of said fuels;

a flue structure coupled to said firebox comprising a plurality of flue gas decelerating chambers for slowing propagation of flue gas, heat exchange to the environment, and further combustion of fuel constituents, said chambers coupled in series through restricting and accelerating passageways for maintaining draft between chambers;

tubular conduit means extending from the firebox through said flue structure and formed with orifices for injecting burning flue gas from the firebox primary combustion into said series coupled chambers to enhance secondary burning in said chambers;

and outlet means for venting the output of said series alternating accelerating and decelerating flue gas structure.

2. A new and improved stove or furnace as set forth in claim 1 wherein said chambers are formed with baffles for deflecting and spreading flue gas accelerated into the chambers.

3. A new and improved stove or furnace for combusting and extracting heat from wood and carbonaceous fuels comprising:

firebox means for primary combustion of said fuel;

a thermal energy "slow propagation" flue structure for receiving and conducting flue gas from the primary burn firebox means said flue structure comprising a plurality of chambers stacked one above the other with common walls separating the chambers, each said chamber communicating with adjacent chambers through successive openings in alternate non-aligned positions in the common chamber walls of said series coupled chambers, said openings adapted to accelerate flue gas and enhance draft between chambers, said chambers adapted to decelerate flue gas, exchange heat to the environment, and contact flue gas with heated portions of the common walls produced by flue gas accelerated into said chamber, at least some of said chambers being formed with baffles for deflecting and spreading flue gas accelerated into the chambers;

an outlet means for venting flue gas from the "slow propagation" thermal energy flue structure.

4. A new and improved stove or furnace as set forth in claim 3 wherein said common walls are formed of refractory material.

5. A new and improved stove or furnace as set forth in claim 3 wherein is included means for introducing secondary air into at least the first chamber of the flue structure.

6. A new and improved stove or furnace as set forth in claim 3 wherein said firebox and flue structure are formed in a cylindrical housing.

7. A new and improved stove or furnace as set forth in claim 3 wherein is included a tubular conduit extending from the firebox through said flue structure chambers and formed with orifices for injecting burning flue gas from the firebox primary combustion into said series coupled chambers to enhance secondary burning in said flue structure chambers.

8. A new and improved fuel burner and heat extractor comprising:

a cylindrical housing;

a firebox at the base of the housing for primary combustion of wood and other carbonaceous fuels, the top of said firebox defined by a circular first plate supported in the cylindrical housing, said plate formed with an opening at one side for drafting and accelerating flue gas from the primary combustion;

a secondary burning chamber over said firebox defined below by said circular first plate and above by a second circular plate supported in said housing, said chamber defined on the sides by the walls of the cylindrical housing and said second circular plate formed with a port on the side opposite the opening in the first circular plate for drafting and accelerating flue gas from the secondary burning chamber;

means for introducing secondary air from outside the stove into the secondary burning chamber;

and a plurality of slow propagation chambers coupled in series through accelerating and drafting passageways from the secondary burning chamber, each said slow propagation chamber defined above and below by a circular plate forming common walls between adjacent chambers supported in the cylindrical housing and defined on the sides by the walls of the housing, each circular plate formed with a port at its side on the opposite side from the ports on next adjacent plates, the port in the lower-plate of each chamber forming an accelerating and drafting inlet to the chamber, the port in the upper plate forming a drafting and accelerating outlet, each chamber formed with a baffle facing the inlet port for deflecting and spreading flue gas accelerated into the chambers;

whereby flue gas from the primary and secondary combustion is alternately accelerated for maintaining draft and decelerated and spread for slowing propagation, exchanging heat to the environment, and further combustion or pyrolysis as the spreading flue gas contacts hot spots in the common wall plates of the chambers produced by accelerating flue gas passing through the non-aligned ports striking the common wall plate with the previous chamber.

9. A new and improved fuel burner and heat extractor as set forth in claim 8 wherein the slow propagation chamber baffles are "V" shaped with the point of the "V" facing the inlet port.

10. A new and improved fuel burner as set forth in claim 8 wherein is included a tubular conduit extending from an open end at the firebox through the plurality of slow propagation flue structure chambers and common wall plates, said tubular conduit formed with orifices or openings for injecting burning flue gas from the firebox primary combustion into said series coupled chambers to enhance secondary burning in said flue structure chambers.

11. A stove or furnace as set forth in claim 8 wherein said secondary air induction means comprises a first elongate tube with fins to facilitate heat exchange positioned below the first passageway means in the primary combustion firebox means, said first elongate tube having an inlet extending outside the stove for receiving secondary air and an outlet extending into the secondary burning chamber, said secondary air induction means also including a second elongate tube positioned within the secondary burning chamber coupled for receiving preheated secondary air from the outlet of the first elongate tube said second tube formed with a slit outlet for delivering a sheet of heated air into the first chamber for secondary burning of flue gas spreading in said chamber.

12. A new and improved stove or furnace for combusting and extracting heat from wood and carbonaceous fuels comprising:

firebox means for primary combustion of said fuels;

and a "slow propagation" flue structure comprising a plurality of flue gas decelerating and spreading chambers coupled in series with the firebox, said chambers and firebox coupled in series through flue gas accelerating and drafting passageways;

at least some of said chambers formed with baffles positioned in the respective chambers to deflect and spread flue gas received from an accelerating and drafting passageway within the chamber;

each said chamber formed with a common wall with an adjacent chamber in the series;

said accelerating and drafting passageways formed in the common walls in non-aligned spaced apart relationships whereby flue gas accelerated through one passageway strikes the common wall with the next chamber forming a hot spot to facilitate secondary combustion of flue gas spreading in the next adjacent chamber.

13. A new and improved stove or furnace as set forth in claim 12 wherein is included a secondary air induction means comprising a heat exchange passageway extending from an inlet outside the stove through the firebox means for preheating secondary air in the flames of primary combustion and further extending into the first flue gas decelerating and spreading chamber of the series of chambers with an outlet means for injecting secondary air into the chamber for secondary combustion of flue gas in said chamber.

14. A new and improved fuel burner as set forth in claim 12 wherein is included a tubular conduit extending from an open end at the firebox through the plurality of slow propagation flue structure chambers and common walls, said tubular conduit formed with orifices or openings for injecting burning flue gas from the firebox primary combustion into said series coupled chambers to enhance secondary burning in said flue structure chambers.

15. A new and improved method for combusting and extracting heat from wood and carbonaceous fuels comprising:

igniting and burning said fuel in a primary combustion;

drafting and accelerating flue gas from the primary combustion;

decelerating and spreading said flue gas to form a turbulent thermal mass;

introducing secondary air into said mass of flue gas to facilitate secondary burning;

drafting and accelerating flue gas from the secondary burning mass, decelerating and spreading said flue gas, slowing propagation of the flue gas, exchanging heat to the environment, and further combusting constituents of the flue gas;

again drafting and accelerating the flue gas;

alternately decelerating and spreading the flue gas for slowing propagation of the flue gas, exchanging heat with the environment, and breaking down constituents of the gas and accelerating and drafting the flue gas and maintaining exhaust draft until final venting to the chimney or atmosphere;

and injecting burning flue gas directly from the primary combustion through a separate pathway into the decelerating and spreading flue gas during the decelerating and spreading steps to enhance further combustion of flue gas constituents

16. A new and improved method for combusting and extracting heat from wood and carbonaceous fuels comprising:

igniting and burning said fuel in a primary combustion;

alternately accelerating and drafting, and decelerating and spreading, the flue gas from said primary burning step, maintaining draft during the accelerating steps and slowing propagation, exchanging heat to the environment, and further combusting or pyrolizing the constituents of the flue gas during the decelerating step;

and injecting a jet of burning flue gas directly from the primary combustion through a separate pathway into the decelerating and spreading flue gas during the decelerating and spreading steps to enhance further combustion of the flue gas constituents during deceleration and spreading.

* * * * *